US009651046B2

(12) United States Patent
Williamson et al.

(10) Patent No.: US 9,651,046 B2
(45) Date of Patent: May 16, 2017

(54) PRE-COMPRESSION DUAL SPRING PUMP CONTROL

(71) Applicant: Magna Powertrain Inc., Concord (CA)

(72) Inventors: Matthew Williamson, Richmond Hill (CA); Manmohan Sehmby, Brampton (CA); Cezar Tanasuca, Richmond Hill (CA); Karthikeyan Ganesan, North York (CA)

(73) Assignee: MAGNA POWERTRAIN INC, Ontario (CA)

( * ) Notice: Subject to any disclaimer, the term of this patent is extended or adjusted under 35 U.S.C. 154(b) by 467 days.

(21) Appl. No.: 14/245,046

(22) Filed: Apr. 4, 2014

(65) Prior Publication Data

US 2014/0294647 A1 Oct. 2, 2014

Related U.S. Application Data

(63) Continuation of application No. PCT/CA2012/000931, filed on Oct. 5, 2012.
(Continued)

(51) Int. Cl.
*F04C 14/22* (2006.01)
*F04C 18/08* (2006.01)
(Continued)

(52) U.S. Cl.
CPC ..... *F04C 18/08* (2013.01); *F01M 1/02* (2013.01); *F01M 1/16* (2013.01); *F04C 2/3442* (2013.01);
(Continued)

(58) Field of Classification Search
CPC ..... F04C 14/226; F04C 18/08
(Continued)

(56) References Cited

U.S. PATENT DOCUMENTS 2,768,585 A * 10/1956 Hardy ..... B62D 5/062 417/213

FOREIGN PATENT DOCUMENTS

| | | |
|---|---|---|
| GB | 675840 | 7/1952 |
| WO | 2006/045188 | 5/2006 |
| WO | 2008/003169 | 1/2008 |

* cited by examiner

*Primary Examiner* — Mark A Laurenzi
*Assistant Examiner* — Anthony Ayala Delgado
(74) *Attorney, Agent, or Firm* — Warn Partners, P.C.

(57) ABSTRACT

A variable capacity vane pump (20) is provided having a pump control ring (44) that is moveable to alter the capacity of the pump (20). A control chamber (60) is formed between the pump casing (22) and the control ring (44). The control chamber (60) is operable to receive pressurized fluid to create a force to move the control ring (44) to reduce the volumetric capacity of the pump (20). A primary return spring (56) acts between the control ring (44) and the casing (22) to bias the control ring (44) towards a position of maximum volumetric capacity. A shaft is coupled at one end to the control ring and a second end of the shaft is positioned a predetermined distance from the casing (22). A secondary return spring (62) is mounted about the shaft and is configured to engage the control ring (44) after the control ring (44) has moved a predetermined amount. The secondary return spring (62) biases the control ring (44) towards a position of maximum volumetric capacity. The secondary return spring (62) acts against the force of the control chamber (60) to establish a second equilibrium pressure.

16 Claims, 9 Drawing Sheets

Related U.S. Application Data

(60) Provisional application No. 61/544,841, filed on Oct. 7, 2011.

(51) Int. Cl.
*F01M 1/02* (2006.01)
*F01M 1/16* (2006.01)
*F04C 2/344* (2006.01)

(52) U.S. Cl.
CPC ... *F04C 14/226* (2013.01); *F01M 2001/0238* (2013.01); *F01M 2001/0246* (2013.01)

(58) Field of Classification Search
USPC ..... 418/191, 24
See application file for complete search history.

PRE-COMPRESSION DUAL SPRING PUMP CONTROL

CROSS REFERENCE TO RELATED APPLICATIONS

The present application is a continuation application filed under 37 CFR 1.53 and 35 U.S.C. 120 and claims priority to International Application No. PCT/CA2012/000931, filed Oct. 5, 2012 which claims priority to U.S. Provisional Patent Application No. 61/544,841, filed Oct. 7, 2011, entitled PRE-COMPRESSION DUAL SPRING PUMP CONTROL, the entire contents of which are incorporated herein for all purposes.

FIELD

The present disclosure relates generally to an improved pump device. More particularly, the present disclosure relates to an improved pump and control device for providing better control of the output of the variable capacity pump having particular application as an oil pump for use in an engine for use in a vehicle.

BACKGROUND

Generally it is known to use a pump for incompressible fluids, such as oil. Often such pumps are of the variable capacity vane type. Such pumps include a moveable pump ring, which allows the rotor eccentricity of the pump to be altered to vary the capacity of the pump.

Having the ability to alter the volumetric capacity of the pump to maintain a pressure is desirable in environments such as automotive lubrication or oil pumps, wherein the pump will be operated over a range of operating speeds. In such environments, to maintain an equilibrium pressure it is known to employ a feedback supply of the working fluid (e.g. lubricating oil) from the output of the pump to a control chamber adjacent the pump control ring or slide, the pressure in the control chamber acting to move the control ring, against a biasing force applied to the control ring from a return spring, to alter the capacity of the pump.

Typically, for such oils pumps that are operated by the engine of the vehicle, the pressure at the output of the pump increases as the operating speed of the pump increases, the increased pressure is applied to the control ring (or slide) to overcome the bias force of the return spring and to move the control ring to reduce the capacity of the pump, thus reducing the output volume and hence the pressure at the output of the pump.

As the pressure at the output of the pump drops when the operating speed of the pump decreases, the pressure applied to the control chamber adjacent the control ring (or slide) decreases. When the pressure applied to the control chamber adjacent the control ring decreases the bias force of the return spring moves the control ring to increase the capacity of the pump, raising the output volume and hence pressure of the pump. In this manner, an equilibrium pressure is obtained and/or maintained at the output of the pump.

Conventionally, the equilibrium pressure is selected to be a pressure that is acceptable for the expected operating (e.g., speed) range of the engine. Necessarily, the selected equilibrium pressure is a compromise because the engine operates over a generally very wide range of speeds. The equilibrium pressure is selected so the oil pump will operate acceptably (to supply sufficient oil to the engine) at lower operating speeds with a lower working fluid pressure than is required at higher engine operating speeds (to supply a greater amount of oil to the engine). To limit undue wear or other damage to the engine, the engine designers will generally select an equilibrium pressure for the pump which meets the worst case (high operating speed) conditions. When this is the case, generally, at lower speeds, the pump will be operating at a capacity greater than necessary for those speeds thereby wasting energy pumping the surplus, unnecessary, working fluid.

Accordingly, there remains a significant need to improve the performance characteristics of a variable capacity vane pump having at least two equilibrium pressures and providing for greater packaging flexibility while providing a more compact pump.

SUMMARY

In at least one exemplary embodiment according to the present invention, there is disclosed a system and method of controlling the capacity of a variable capacity pump that mitigates and even obviates at least one disadvantage of the prior art. In the least one exemplary embodiment according to the present invention, there is disclosed a variable capacity pump that mitigates and may even obviate at least one disadvantage of the prior art. In the least one exemplary embodiment according to the present invention, the variable capacity provides for greater packaging flexibility while providing a more compact pump.

In at least one exemplary embodiment according to the present invention, there is disclosed a variable capacity pump, in particular a variable capacity vane-type pump, having a moveable pump control ring (or slide). The moveable pump control ring alters the capacity of the pump based upon the operating speed of the pump. In one exemplary embodiment, the pump is operable at two selected equilibrium pressures. The pump has a casing having a pump chamber therein and a vane pump rotor is rotatably mounted in the pump chamber. A control ring encloses the vane pump rotor within the pump chamber and is moveable within the pump chamber to alter the capacity of the pump. The control ring enclosing the vane pump rotor defines a control chamber along with the pump casing. The control chamber receives pressurized fluid which pressure acts on the control ring to move the control ring within the control chamber to reduce the volumetric capacity of the pump.

In at least one exemplary embodiment according to the present invention the variable capacity pump includes a primary return spring acting between the control ring (or slide) and the casing (or other base) to apply a biasing force to move the control ring toward a position of maximum volumetric capacity and away from the position of minimum volumetric capacity. The primary return spring acts against the force of the control chamber applied to the control ring to move the control ring toward the biasing spring which net out to establish a first equilibrium pressure. In one exemplary embodiment, a secondary return spring is mounted, in one embodiment it is mounted in the casing, and is configured to engage the control ring after the control ring has moved a predetermined amount. The secondary return spring also biases the control ring towards a position of maximum volumetric capacity. The force of secondary return spring is designed to act against the force of the control chamber, in addition to the force of the first return spring, to establish a second equilibrium pressure. In an alternate exemplary embodiment, the secondary spring is pretensioned and includes a gap for delaying the action of the biasing force of the second pretensioned spring.

DETAILED DESCRIPTION

Figure 1:
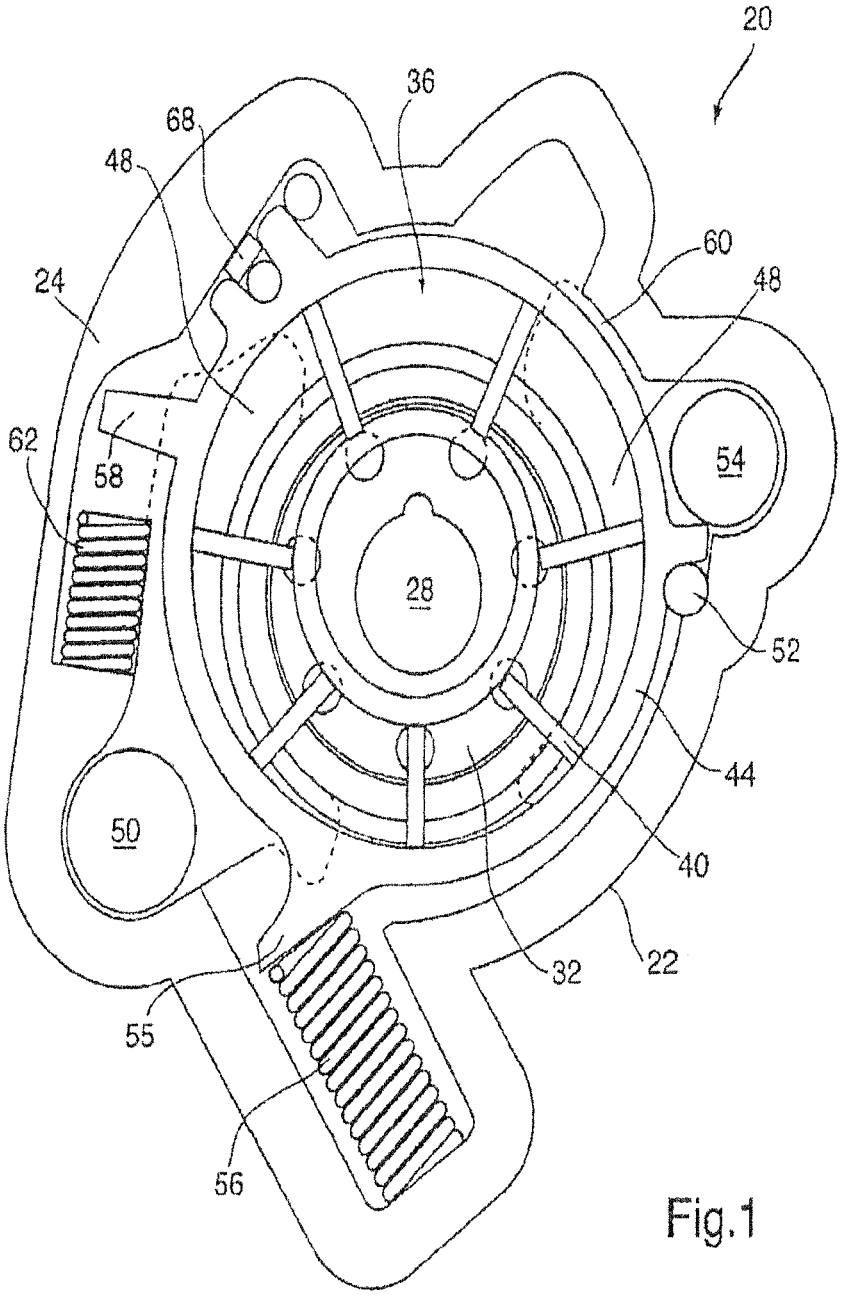
FIG. 1 shows a partial, graphic plan view of a variable capacity pump in accordance with the present invention.
Figure 2:
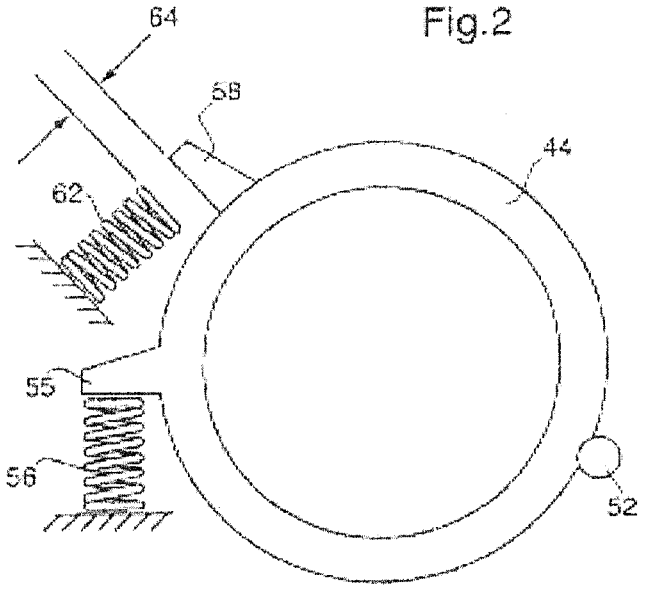
FIG. 2 shows a partial, graphic plan view of a control ring or slide utilized in the variable capacity pump of FIG. 1.
Figure 3:
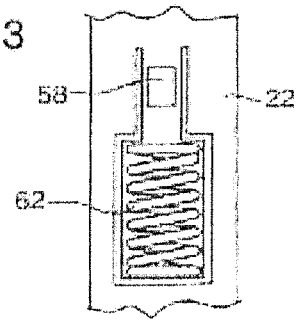
FIG. 3 shows a partial, schematic elevational view of the secondary spring system of the variable capacity pump of FIG. 1.

Referring generally to FIGS. 1 through 11, and in particular to FIGS. 1 through 3, there is disclosed a variable capacity vane pump 20 in accordance with an embodiment of the present disclosure as best shown FIG. 1. The pump 20 includes a casing 22 with a front face 24 which is sealed with a pump cover (not shown) using any known or appropriate sealing device such as a suitable gasket seal. The pump 20 is coupled and sealed with an engine (not shown) or the like for which the pump 20 will supply a pressurized working fluid such as oil.

The pump 20 includes a drive shaft 28 which is driven by any suitable driving device, such as a power take off from the engine or other mechanism to operate pump 20. As drive shaft 28 is rotated, a pump rotor 32 located within a pump chamber 36 is driven by the drive shaft 28. A series of movable or slidable pump vanes 40 rotate as the rotor 32 rotates. An outer end of each vane 40 engages an inner circumferential surface of a pump control ring 44 which forms the outer wall of pump chamber 36. The pump vanes 40 and the outer wall of pump chamber 36 divide the pump chamber into a series of expanding and contracting pumping chambers 48 that is further defined by the inner surface of the pump control ring 44 and the pump rotor 32.

Pump control ring 44 is mounted within the casing 22 at a pivot pin 52 that allows the center of pump control ring 44 to be moved relative to the center of rotor 32. As the center of pump control ring 44 is located eccentrically with respect to the center of pump rotor 32 and each of the interior of pump control ring 44 and pump rotor 32 are circular in shape, the volume of working fluid chambers 48 changes as the chambers 48 rotate around pump chamber 36, with their volume becoming larger at the low pressure side (the left hand side of pump chamber 36 in FIG. 1) of pump 20 and smaller at the high pressure side (the right hand side of pump chamber 36 in FIG. 1) of pump 20. This change in volume of working fluid chambers 48 generates the pumping action of pump 20, drawing working fluid from an inlet port 50 and pressurizing and delivering it to an outlet port 54.

By moving pump control ring 44 about pivot pin 52 the amount of eccentricity, relative to pump rotor 32, can be changed to vary the amount by which the volume of working fluid chambers 48 change from the low pressure side of the pump 20 to the high pressure side of the pump 20, thus changing the volumetric capacity of the pump 20. Still referring to FIGS. 1 and 2, a primary return spring 56 engages tab 55 of control ring 44 and casing 22 to bias pump control ring 44 to the position, shown in FIG. 1, wherein the pump 20 has a maximum eccentricity.

Control chamber 60 is formed between pump casing 22, pump control ring 44, pivot pin 52 and a resilient seal 68, mounted on pump control ring 44 and abutting casing 22. In the illustrated embodiment as best shown in FIG. 1, the control chamber 60 is in direct fluid communication with pump outlet 54 such that pressurized working fluid from the pump 20 which is supplied to pump outlet 54 also fills control chamber 60. However, control chamber 60 need not be in direct fluid communication with pump outlet 54 and can instead be supplied from any suitable source of working fluid, such as from an oil gallery in an automotive engine being supplied by pump 20.

Referring now in particular to FIG. 2, the secondary control of the pump 20 is provided by the control ring 44 having a secondary tab 58 circumferentially spaced from the first or primary tab 55. Casing 22 is configured to house a secondary spring 62 in a pre-loaded state. Secondary spring 62 is a high rate spring relative to spring 56, preferably, which is a low rate spring. Referring now in particular to FIGS. 1 and 3, the casing 22 is configured to house spring 62 in a pre-loaded or compressed state or position. The secondary tab 58 of the control ring 44 is spaced a predetermined distance from the spring 62 by a gap 64, while the control ring 44 is in a maximum flow capacity state.

Figure 4:
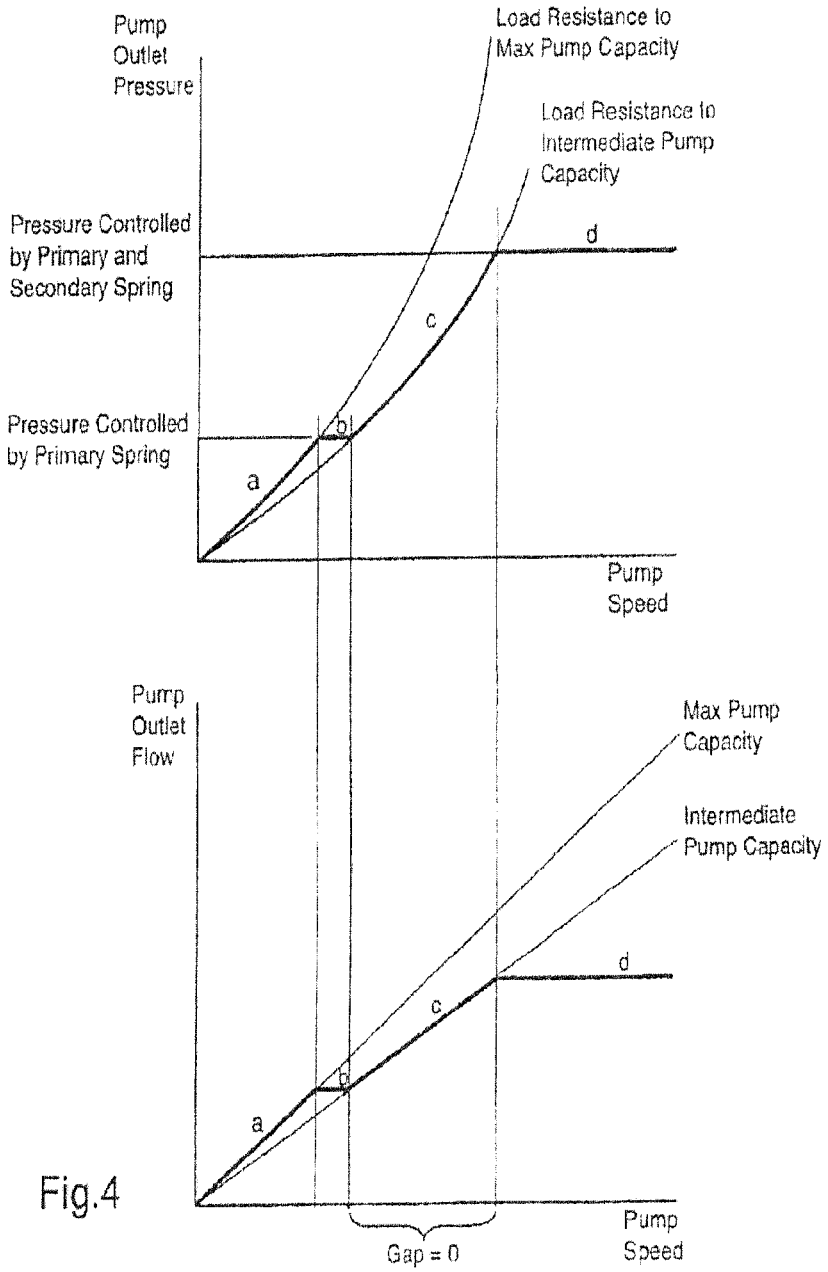
FIG. 4 shows a graph illustrating performance of a variable capacity pump of FIG. 1.

In operation, pressurized working fluid in control chamber 60 acts against the pump control ring 44. When the force resulting from the pressure of the pressurized working fluid on pump the control ring 44 is sufficient to overcome the biasing force of the return spring 56, the pump control ring 44 pivots about pivot pin 52, in a counter-clockwise direction as shown in FIGS. 1 and 2, to reduce the eccentricity of the pump 20. When the pressure of the pressurized working on the control ring 44 is not sufficient to overcome the biasing force of return spring 56, the pump control ring 44 remains pivoted clockwise about pivot pin 52 due to the force of the return spring 56, to increase the eccentricity of pump 20. The characteristics of the fluid (pressure and flow) at the output of the pump 20 can be graphed as a function of the operating speed of the pump. Referring to FIG. 4, segment "a" of the graph represents the performance of the pump 20 when the eccentricity of the pump 20 is at a maximum when the control ring 44 is at the greatest clockwise position due to the force of the return spring 56 on the control ring 44. The flow of the fluid output by the pump 20 follows a fixed or maximum capacity line and the pressure of the fluid follows a load resistance curve that relates to this fixed capacity.

Segment "b" on the graph represents the point at which the pre-load of the low rate return spring 56 is overcome by the pressure acting on the control ring 44 and the control ring 44 pivots. The pressure and flow of the fluid at the output remain substantially constant according to the equilibrium between the pressure and the spring force of the primary return spring 56. At this point, the secondary tab 58 is not in contact with the high rate spring 62.

Segment "c" of the graph represents when the gap 64, as best shown in FIG. 3, closes to zero and the secondary tab 58 contacts the high rate or secondary spring 62, but the pressure in chamber 60 is not sufficiently high enough to overcome the pre-load of the secondary spring 62. The eccentricity of the pump 20 therefore remains constant at this intermediate value and the output flow follows another (smaller) fixed capacity line. The pressure of the flow follows a new load resistance curve that relates to this lower value of pump displacement.

Segment "d" of the graph of FIG. 4 represents when the fluid pressure acting in chamber 60 on the control ring 44 overcomes the pre-load of the high rate spring 62 and the control ring 44 again moves counter-clockwise on the pivot 52. The pump outlet pressure and flow remain substantially constant according to the equilibrium between the pressure in chamber 60 and the combined forces of springs 56 and 62. When the pressure of the pressurized working fluid in chamber 60 is not sufficient to overcome the combined biasing forces of return springs 56 and 62, pump control ring 44 pivots about pivot pin 52, in the clockwise direction to increase the eccentricity of pump 20.

The arrangement of the first and second springs 56 and 62, respectively, is illustrated in FIGS. 1-3 as being in separate housings within the casing 22. While it is apparent to those skilled in the art that the two springs 56 and 62 could be arranged in other configurations, including concentric springs within the same housing, without departing from the scope of the present disclosure, other arrangements have been found that provide particular packaging and performance improvements that are considered not apparent. In one particular example disclosed in FIG. 5 there is shown an alternate arrangement of the second spring 62 as compared to FIGS. 1 through 3. In this alternate exemplary embodiment in FIG. 5, the variable capacity pump 20 of an alternate embodiment includes a first control spring 62 associated with a first tab or extension member 55 of the control ring 44 similar to the embodiment of FIG. 1. The pump 20 of FIG. 5 further includes the second spring 62 acting on the tab or second extension member 58 of the control ring 44. The pump 20 of FIG. 5 further includes a shaft having a first end passing through a hole or passage in the tab 58 and the shaft extends distal there from to a second end defining a gap (g) with the housing 22. The first end of the shaft is coupled to the tab 55 of the control ring 44 using a pair of nuts for securing the shaft to the control ring 44 but may be coupled using any known or appropriate fastener or similar device. The second end of the shaft includes a pretension element formed or coupled at the second end to define a shoulder for trapping the spring 62 between the tab 58 and the pretension element of the second end of the shaft. The operation of the pump 20 of FIG. 5 can be similar to that of the embodiment of FIGS. 1-4.

Figure 5:
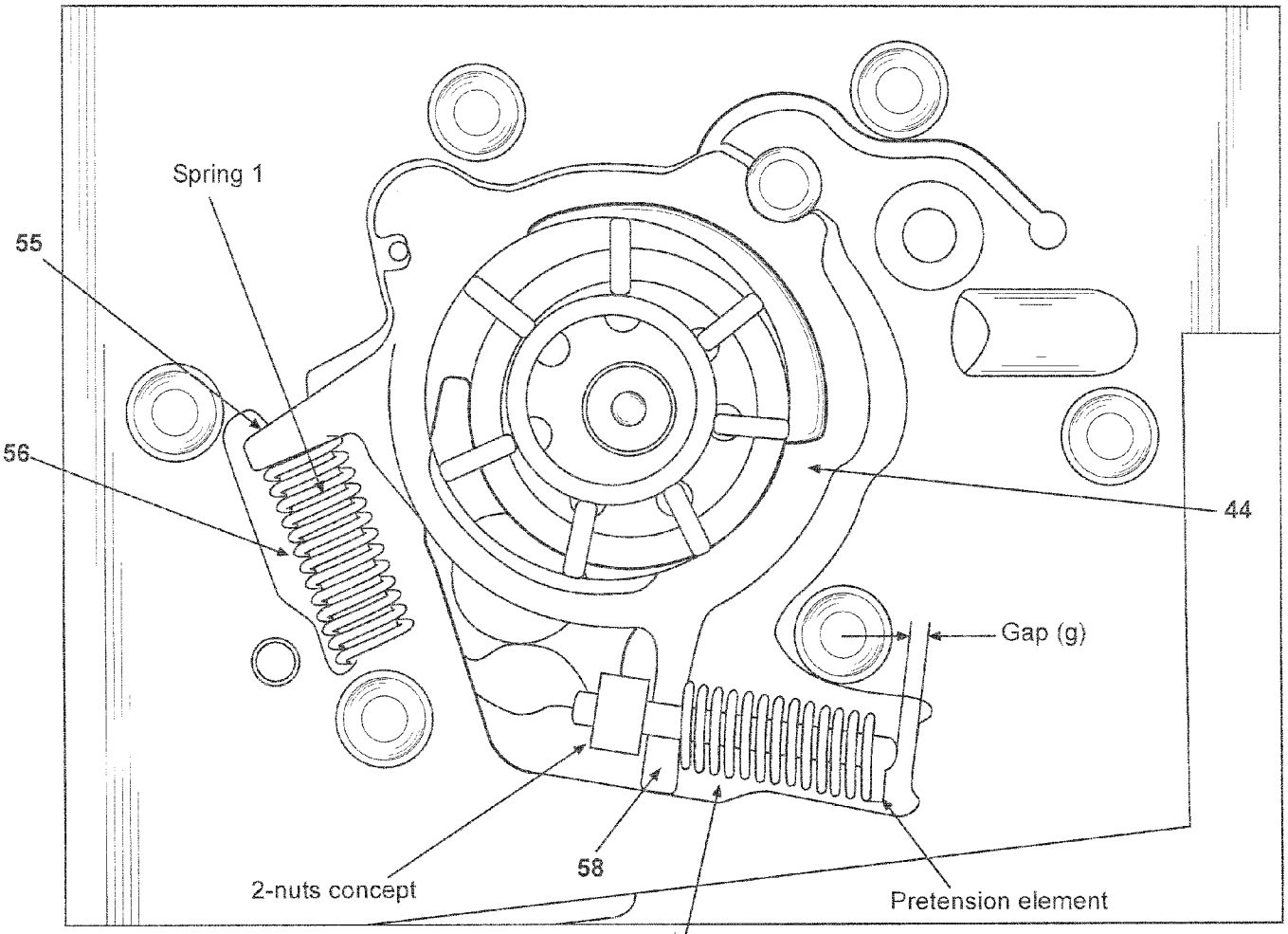
FIG. 5 shows a partial, graphic plan view of a variable capacity pump in accordance with an alternate exemplary embodiment of the present invention.
Figure 6:
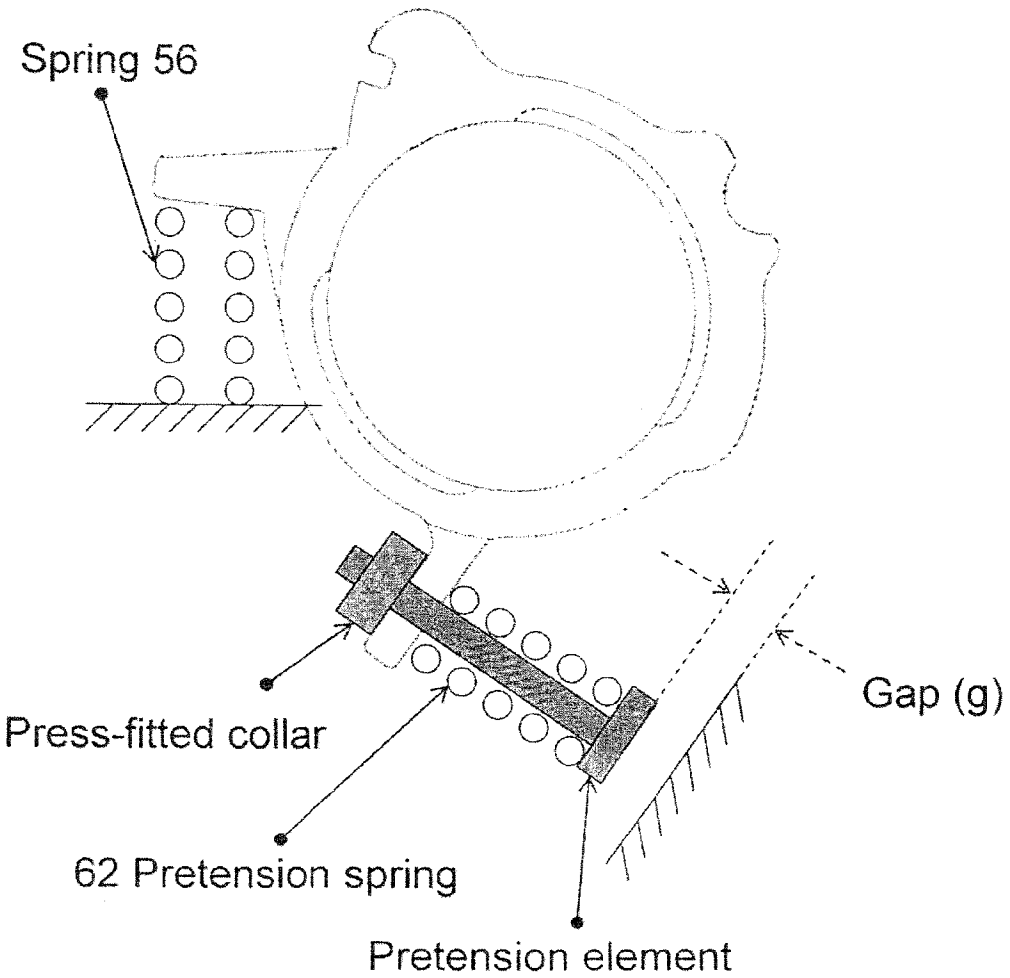
FIG. 6 shows a partial, schematic elevational view of a secondary dual spring system according to an alternate embodiment for use in a variable capacity pump.

Referring now to the alternate embodiment of the pump 20 shown in FIG. 6, pump 20 is generally very similar to the pump 20 of the other alternate exemplary embodiment of FIG. 5 except the shaft in FIG. 6 is coupled or secured in the passage in the tab 58 of the control ring 44 using a press-fitted collar. The press-fitted collar is designed to be secured to the first end of the shaft such that the shaft pretensions the second spring, trapped between the shoulder of the pretension element of the second end of the shaft and the tab 58 of the control ring while also defining the Gap (g) desired for having the variable capacity vane pump 20 according to FIG. 6 operate according to preferred operating curve shown in FIG. 4.

Figure 7:
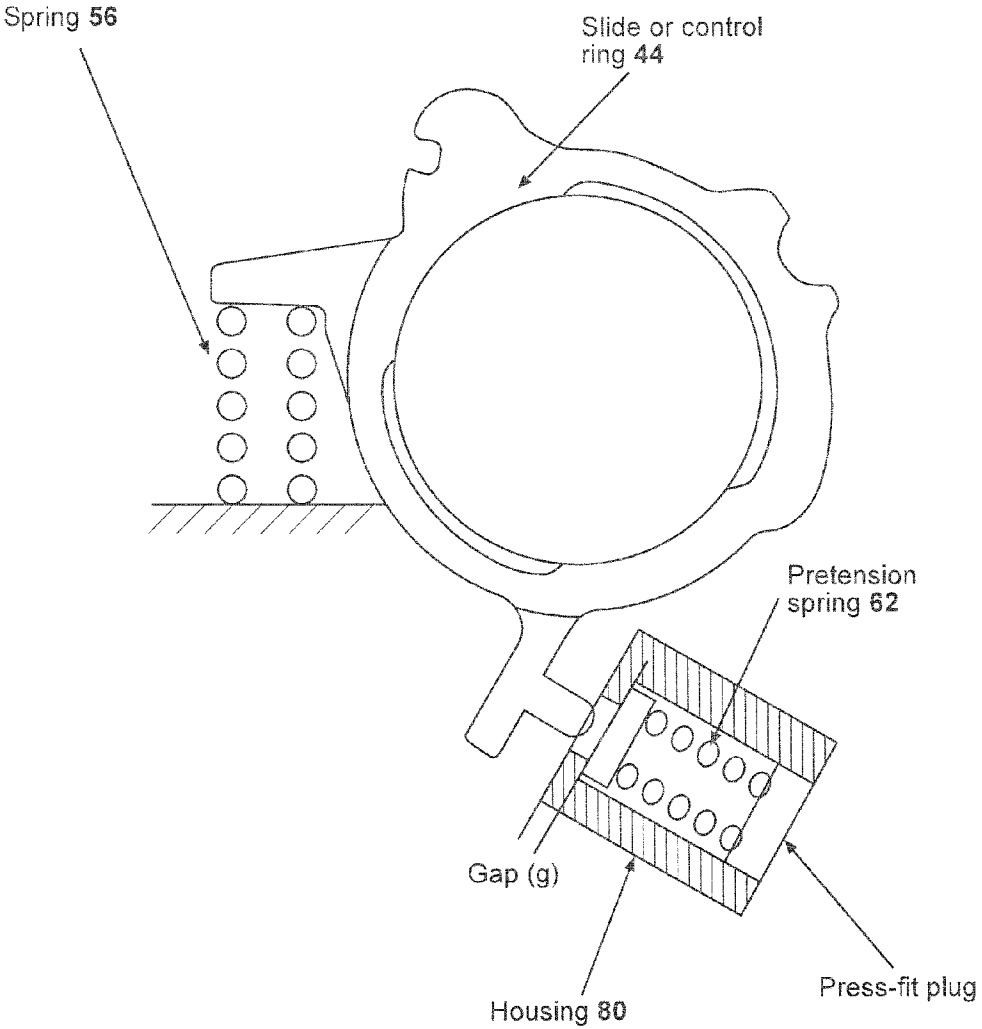
FIG. 7 shows a partial, schematic elevational view of a modular, secondary spring system according to an alternate embodiment for use in a variable capacity pump.
Figure 9:
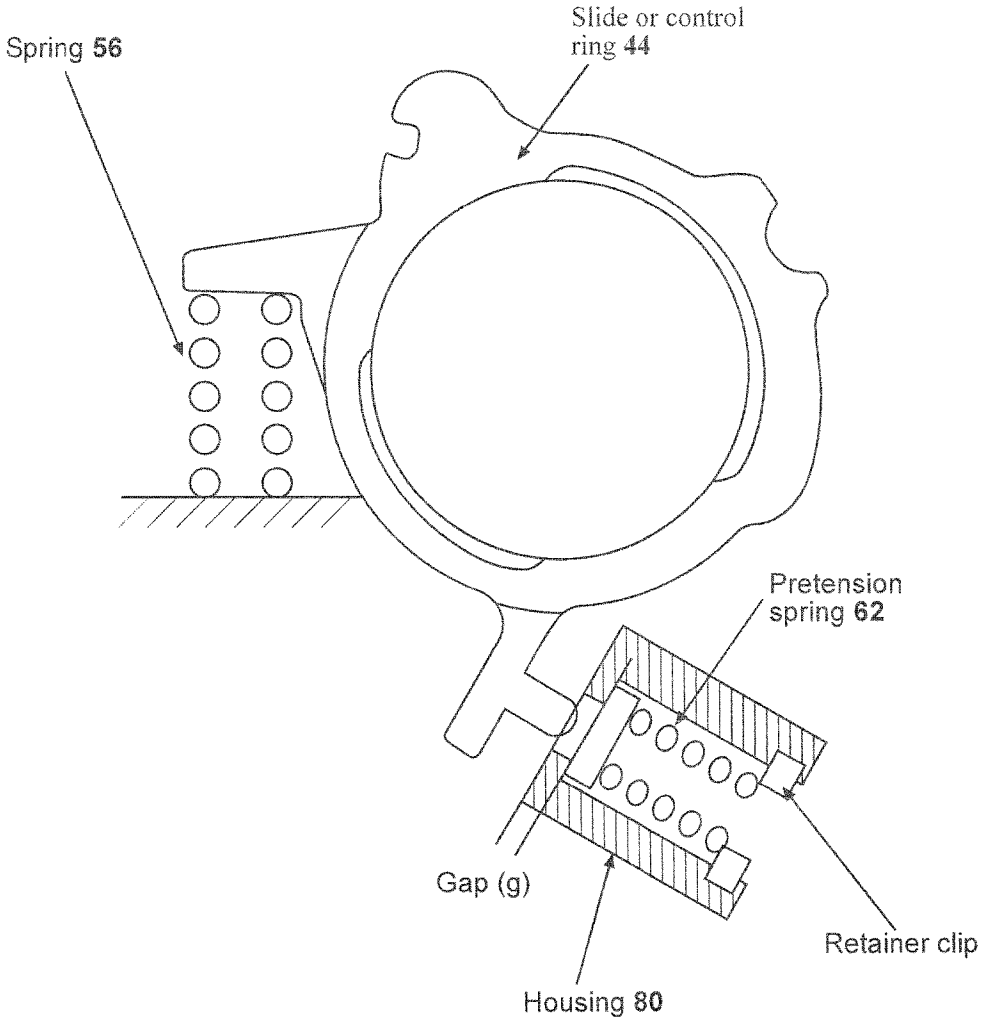
FIG. 9 shows a partial, schematic elevational view of a modular, secondary spring system according to a further alternate embodiment for use in a variable capacity pump.

Referring now to the alternate embodiments of the pumps 20 shown in FIGS. 7 and 9, the pumps 20 are generally very similar to the pumps 20 of FIG. 1 or 5, except that the pumps 20 include a modular or second housing 80 for operating or holding the second control spring 62 and defining the Gap (g). The second housing 80 is a generally rectangular (in cross-section as shown in the figures) member having a first end aligned with the tab 58 of the control ring 44 and a second end distal from the first end. In FIG. 7 the second end is advantageously closed using a press-fitted plug for holding the second control spring 62 within the second housing 80 and transferring the force of the second spring 62 to the slide or control ring 44. In the alternate exemplary embodiments of FIGS. 7 and 9, the tab or extension member 58 of the control ring 44 includes a first portion and a second portion aligned at an angle from the first portion. Preferably the second portion is aligned toward the first end of the housing 80 to pass through a passage in the first end of the housing 80 and contact a first member for transferring the forces between the control ring 44 and the second spring 62. The opening in the first end of the housing 80 is designed to define the Gap (g) using the length of the first end of the housing 80. As the pressure in the pump 20 of FIGS. 7 and 9 increases with the speed of the pumps 20, the second portion of the tab 58 travels through the Gap (g) distance until it contacts the first member transferring the force to the second spring 62 as the first member moves in the housing 80 toward the second end. The second portion of the tab 58 extending at an angle with respect to the second portion of the tab 58 can be advantageously used to define a limit of travel for the tab 58 and thus the control ring 44.

Figure 8:
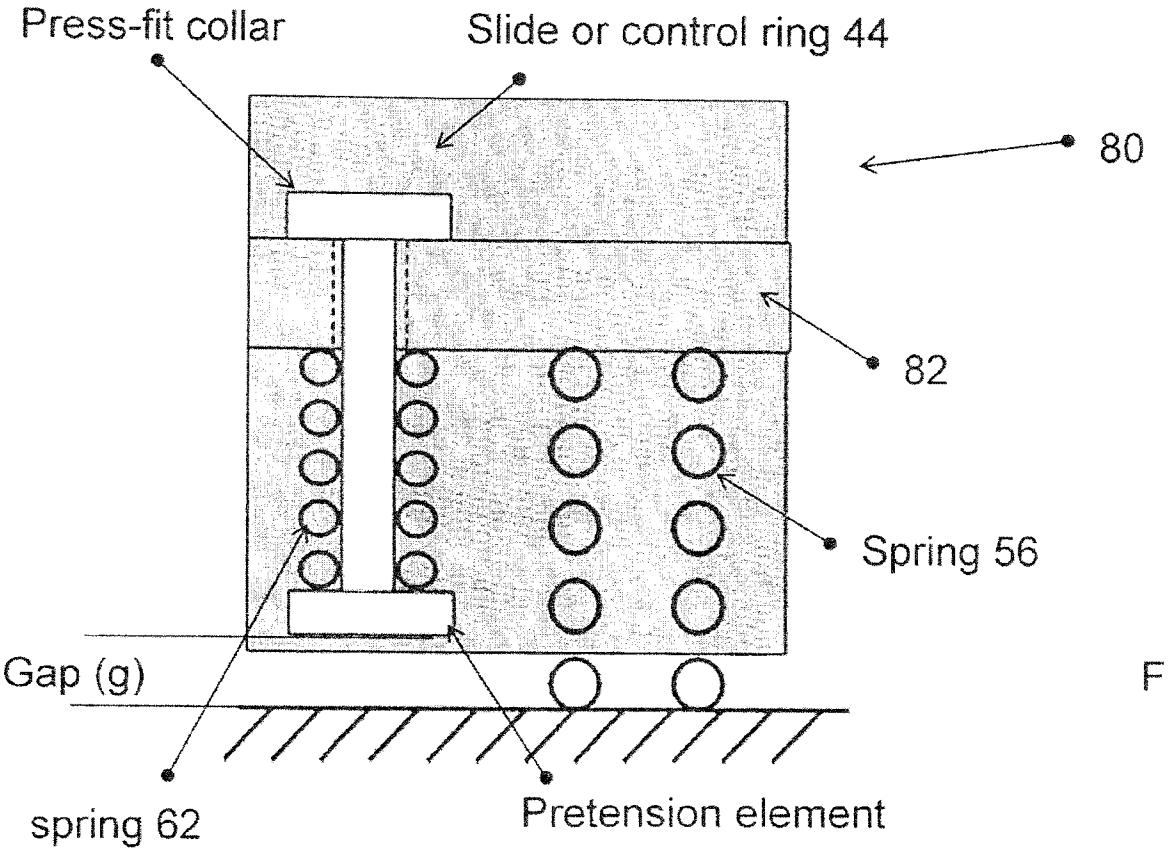
FIG. 8 shows a partial, schematic elevational view of a combination dual spring system according to an alternate embodiment for use in a variable capacity pump.

Referring now to the alternate exemplary embodiment of the pump 20 including a spring housing 80 and first and second springs 56 and 62, respectively as shown in FIG. 8, the housing 80 is shown holding the first and second control springs 56 and 62, respectively. The housing 80 of FIG. 8 provides significantly improved packaging flexibility in the pumps 20 since the first and second control springs 56 and 62, respectively, may be more closely co-located. In particular, the first and second control springs 56 and 62, respectively, are aligned parallel or side-by-side within the housing 80 and the first end of each of the first and second control springs 56 and 62, respectively, act against a common first portion or wall 82 extending within the housing 80. Similar to the alternate exemplary embodiments of FIGS. 7 and 9, the spring housing 80 can be made more modular such that it can be manufactured either unitarily with the housing 22 of the pump 20 or separately and then made integral with the housing 22 or other part of the pump 20. Such a design for the housing 80 provides significantly greater design flexibility and utilization of the pump 20. While the housing 80 is shown having a generally rectangular cross section, it should be understood that other shapes are possible.

Figure 11:
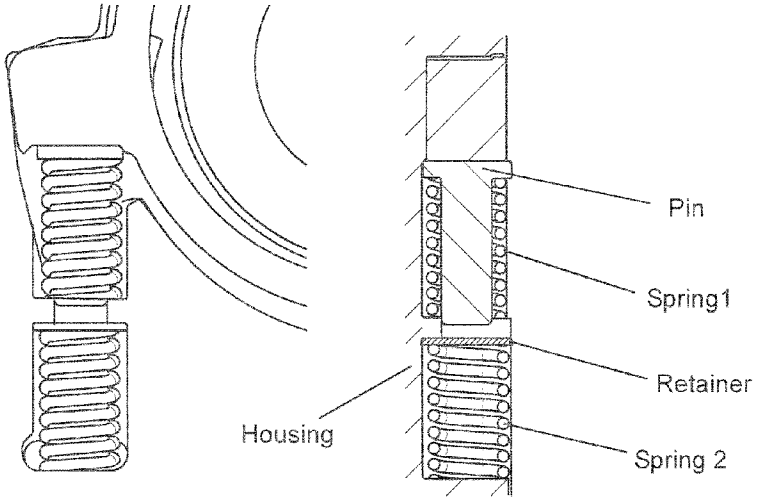
FIG. 11 shows a partial, schematic elevational view of a combination dual spring system according to a further alternate embodiment for use in a variable capacity pump.
Figure 10:
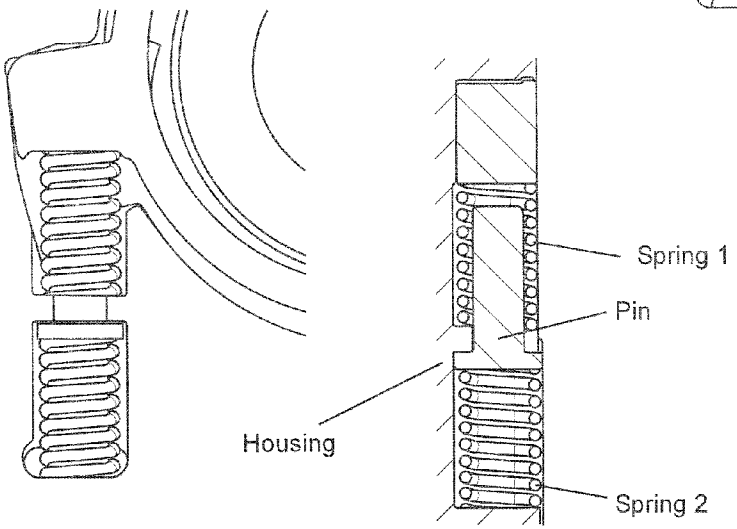
FIG. 10 shows a partial, schematic elevational view of a combination dual spring system according to a further alternate embodiment for use in a variable capacity pump.

Referring now to the alternate exemplary embodiments as shown in FIGS. 10 and 11, the pump 20 includes the housing 80 and arrangements of the first and second springs 58 and 62, respectively. The common housing 80 is shown holding the first and second control springs 56 and 62, respectively, in an in-line or series arrangement as compared to the side-by-side or parallel arrangement shown in FIG. 8. The housing 80 of FIGS. 10 and 11 also provides significantly improved packaging flexibility in the pump 20 since the first and second control springs 56 and 62, respectively, may be more closely aligned and co-located. In particular, the first and second control springs 56 and 62, respectively, are aligned in-line within the housing 80. Referring in particular to FIG. 10, the first spring 56 is located closest to the tab 58 of the control ring or slide 44 and the second control spring 62 is located distal. A pin having a substantially t-shape is located between the first and second springs 56 and 62, respectively. The tab 58 will first act on the spring 56 (Spring 1) over a given distance until the tab 58 contacts the pin and begins compressing the second spring 62 (Spring 2). The alternate embodiment shown in FIG. 11 is similar to that of FIG. 10 except the t-shaped pin is located between the first control spring 56 and the tab 58 of the control ring or slide 44 and a retainer is provided between the second control spring 62 and the second and of the pin such that once the first control spring 56 (Spring 1) compresses a given distance, the force from the tab 58 will begin to be applied against the force of the second control spring 62 (Spring 2).

Any numerical values recited herein or in the figures are intended to include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

We claim:

1. A variable capacity vane pump having a control ring for altering the output capacity of the pump, the variable capacity vane pump comprising: a pump casing having a pump chamber therein, the pump casing having an inlet port and an outlet port; vane pump rotor rotatably mounted in the pump chamber; the control ring enclosing the vane pump rotor within the pump chamber, a plurality of vanes operatively engaging the rotor and frictionally engaging the control ring for pumping a fluid from the inlet port, through the pump chamber and to the outlet port, the control ring being moveable within the pump chamber to alter the volumetric capacity of the pump; a variable control chamber defined by the pump casing and the control ring, the control chamber operable to receive pressurized fluid to create a force to bias the control ring toward a position of minimum volumetric capacity of the pumping chambers; a first return spring for biasing the control ring in a direction toward a position of greater volumetric capacity of the pump, the force of the first return spring acting against the force of the control ring to establish a first equilibrium; a second return spring for biasing the control ring in a direction toward a position of greater volumetric capacity of the pump, the force of the second return spring acting against the force of the control ring after the control ring has moved at least a first predetermined amount against the biasing force of the first return spring; and a shaft having a first end coupled to a tab of the control ring and a second end located distal from the first end and the control ring, the second end of the shaft being spaced a predetermined distance from the housing of the pump, wherein the second end of the shaft includes a pretension element coupled at the second end to define a shoulder for trapping the second spring between the tab and the pretension element of the second end of the shaft, and wherein the second spring is located between the control ring and the second end.

2. The variable capacity vane pump of claim 1 wherein the second return spring is pre-loaded.

3. The variable capacity vane pump of claim 1 further comprising a second housing for containing at least a portion of the second return spring and the shaft.

4. The variable capacity pump of claim 3 wherein the second housing is integral with the casing.

5. The variable capacity vane pump of claim 1 further comprising a second housing for containing at least a portion of the second return spring and the shaft and wherein the second housing comprising a first end and a second closed end comprising a press-fit plug.

6. The variable capacity vane pump of claim 1 further comprising a second housing for containing at least a portion of the second return spring and the shaft and wherein the second housing comprising a first end and a second closed end comprising a retainer clip coupled to a shoulder of the second housing and trapping the second return spring within the housing.

7. The variable capacity vane pump according to any one of claim 1 further comprising a second, modular housing for holding the first and second return springs and defining a Gap (g) between when the first return spring acts and the second return spring acts.

8. The variable capacity vane pump claim 1 wherein the first and second return springs define a Gap (g) between the first return spring acts and the second return spring acts and wherein the first and second return springs are aligned in parallel.

9. The variable capacity vane pump claim 1 wherein the first and second return springs define a Gap (g) between the first return spring acts and the second return spring acts and wherein the first and second return springs are aligned in series.

10. The variable capacity pump of claim 1 further comprising a pin having a substantially t-shape is located between the first and second control springs and the first and second control springs are aligned in-line within a housing.

11. A variable capacity vane pump having a control ring for altering the output capacity of the pump, the variable capacity vane pump comprising: a pump with a housing having a pump chamber therein, the pump casing having an inlet port and an outlet port; a vane pump rotor rotatably mounted in the pump chamber the control ring enclosing the vane pump rotor within the pump chamber, a plurality of vanes operatively engaging the rotor and frictionally engaging the control ring for pumping a fluid from the inlet port, through the pump chamber and to the outlet port, the control ring being moveable within the pump chamber to alter the volumetric capacity of the pump; a variable control chamber defined by the pump casing and the control ring, the control chamber receives pressurized fluid to create a force to bias the control ring toward a position of minimum volumetric capacity of the pumping chambers; a first return spring for biasing the control ring in a direction toward a position of greater volumetric capacity of the pump, the force of the first return spring acting against the force of the control ring to establish a first equilibrium; a second return spring for biasing the control ring in a direction toward a position of greater volumetric capacity of the pump, the force of the second return spring acting against the force of the control ring after the control ring has moved at least a first predetermined amount against the biasing force of the first return spring; and a pretension element rotatably connected to the control ring, where the pretension element includes a shoulder formed or coupled to an end of the second return spring for trapping the spring between the control ring and the pretension element.

12. The variable capacity vane pump of claim 11 wherein the pretension element includes a shaft having a first end coupled to the control ring and a second end located distal from the first end and the control spring, the second end of the shaft being spaced a predetermined distance from the housing of the pump, and wherein the second return spring is located between the control ring and the second end.

13. The variable capacity vane pump of claim 11 wherein the pretension element connects an extension member of the control ring, said extension member has a passage therein and the pretension element has a shaft having a first end passing through the passage in the extension member of the control ring and the shaft has a second end distal from the first end, the second end having the shoulder of the pretension element, wherein the second return spring is located between the extension member of the control ring and the shoulder of the shaft.

14. The variable capacity vane pump of claim 11 further comprising a second, modular housing for holding the first and second return springs and defining a Gap (g) between the first return spring and the second return spring.

15. The variable capacity vane pump claim 11 wherein the first and second return springs define a Gap (g) between when the first return spring and the second return spring and wherein the first and second return springs are aligned in parallel.

16. The variable capacity vane claim 11 wherein the first and second return springs define a Gap (g) between when the first return spring acts and the second return spring and wherein the first and second return springs are aligned in series.

* * * * *